United States Patent [19]

Klein

[11] 4,262,815

[45] Apr. 21, 1981

[54] CONICAL CAN END WITH A GATE AND OPENING TAB AT THE CONE APEX

[76] Inventor: Gerald B. Klein, 13451 Stuart Ct., Broomfield, Colo. 80020

[21] Appl. No.: 128,582

[22] Filed: Mar. 10, 1980

[51] Int. Cl.[3] ..... B65D 17/34; B65D 17/32

[52] U.S. Cl. ..... 220/273; 220/269; 220/380; 222/541

[58] Field of Search ..... 220/265-273, 220/380; 222/541; 215/254, 255

[56] References Cited

U.S. PATENT DOCUMENTS

| | | | |
|---|---|---|---|
| 3,076,584 | 2/1963 | Sherlock | 222/541 |
| 3,403,811 | 10/1968 | Moller et al. | 220/273 |
| 4,215,792 | 8/1980 | Klein | 220/268 |

*Primary Examiner*—George T. Hall

*Attorney, Agent, or Firm*—Dennis O. Kraft

[57] ABSTRACT

This invention concerns a conical can end wherein the central panel of the end is drawn to form a conical frustum with a ring-shaped aperture at its apex end. A recessed panel closes this aperture. A scoreline in this aperture panel defines a gate therein and an opening tab is connected to the gate and placed in the aperture. The tab is pulled or lifted to rupture the score line to open the can end. The tab may be used to remove the gate from the panel or push the gate inwardly with the gate being hinged to the aperture panel.

11 Claims, 14 Drawing Figures

CONICAL CAN END WITH A GATE AND OPENING TAB AT THE CONE APEX

This invention relates to a conical beverage can end with a gate at the apex of the conical can end which is opened by a tab attached to the gate.

The conical form alluded to is a conical frustum and the reference "apex" herein means the top of the frustum and the aperture thereon. Also, it is to be noted that while the walls of a regular cone converge towards the apex as straight-line elements, this is not essential and such elements may be curved lines to produce unique forms which nevertheless converge to an apex and may be called "conical".

When cans began to replace bottles for dispensing beverages such as beer, cans with conical ends were used to simulate the form of a bottle. A pouring spout was formed at the apex end which was closed by a conventional crown. These ends would not effectively nest and this was disadvantage. As beverage cans became more popular, flat panel ends were introduced and gradually dominated the market. Economic packaging and manufacturing factors were largely responsible for this. Nevertheless, certain advantages existed with the conical ends which cannot be found in flat ends. For example, pouring and drinking from a can having a conical end is much more desirable than pouring and drinking from a can having a flat end with an eccentric opening.

There is a definite need for a can having a conical end which permits nesting and which can be manufactured at a cost competitive with a flat panel end.

In the present state of the art, the can end gates, with which the present invention is concerned, are formed in a substantially flat end by scoring the outline of the gate near the periphery of the end, in an eccentric position. If the gate is to be removed, the score is extended completely about the gate outline and a pull tab or ring is attached to be pulled t remove the gate. If the gate is hinged to the end, the score is extended about the gate outline from each side of the hinge. A lift lever is attached to the outside of the gate. It is lifted and rotated to push the gate downwrdly into the can to open it.

The present invention contemplates the use of a pull tab or a lift lever in a recessed aperture at the apex of a conical end by necessary modifications of structure and combinations thereof, to render the same suitably functional in the restricted environment of the aperture, and also in order to permit a complete nesting of the end.

The objects of the invention are to provide a novel and improved conical can end with a gate and a pull tab or lever at the apex and which: is easily attached to a can body in a regular manner; is easy to open and to pour or drink a beverage thereform; requires only simple, common steps in its manufacture; easily and compactly nests with the other ends when manufactured; and is simple in appearance, reliable in use, and economical in cost, using a minimum of material in its manufacture.

With foregoing and other objects in view, my invention comprises constructions, combinations and arrangements of parts and elements as hereinafter described, defined in the appended claims and illustrated, in preferrd embodiments, in the accompanying drawings in which:

Figure 1:
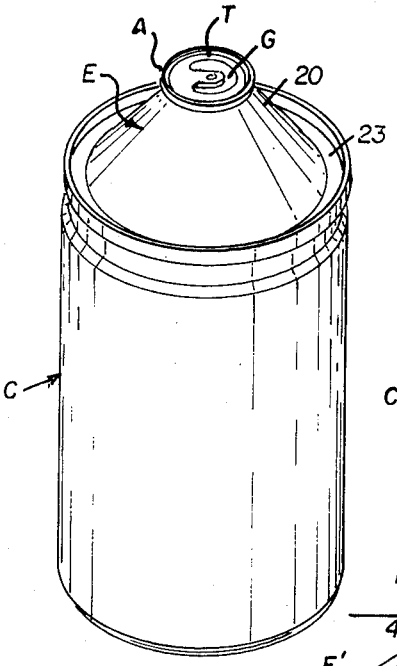
FIG. 1 is an isometric view of a can having a frustoconical end and improved pull-tab gate in the end.
Figure 2:
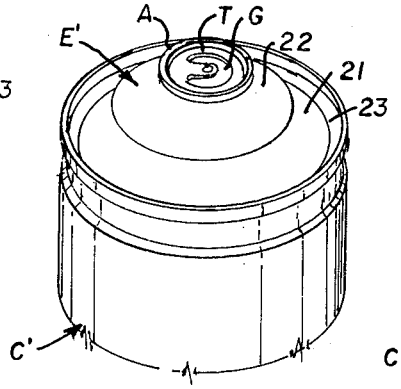
FIG. 2 is an isometric view of the upper portion of a can similar to FIG. 1 but having a frusto-conelike end made up of compound radii.
Figure 3:
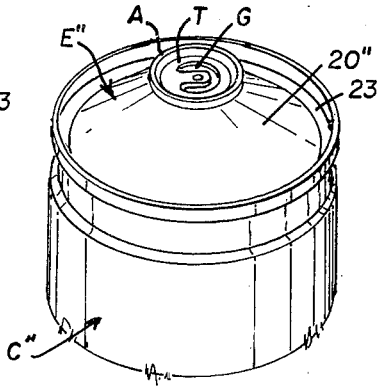
FIG. 3 is an isometric view of the upper portion of a can similar to FIG. 1 but with an end having a flatter conical portion.

Referring more particularly to the drawing, the can C of FIG. 1 is closed by a conical end E having a regular frustocone surface 20 with an aperture A at its apex. A gate G is formed in a recessed panel across this aperture and a pull tab T attached to the gate is positioned in the recess as will be hereinafter further described. The can C′ of FIG. 2 is closed by a cone-like end E′, essentially the same as the end E of FIG. 1 but with the cone-like portion being formed by a larger compound radii 21 and a smaller compound radii 22. An aperture A at the apex of the segment 22 includes a gate G in a recessed panel across the aperture and a pull tab T attached to the gate and positioned in the recess. The can C″ of FIG. 3 is closed by a cone-like end E″ essentially the same as the end E of FIG. 1 but with the end E″ having a comparatively flat cone surface 20″. An aperture A at the apex of the surface 20″ includes a gate G in a recessed panel across the aperture and a pull tab T attached to the gate and positioned in the recess. It is to be noted that the variations of the cone form of FIGS. 1, 2, and 3 are not especially significant insofaras the present invention is concerned. The different conical forms are to enhance the appearance of the can and such are optional, based also upon considerations of stacking, packaging and the like. It is preferable that the end be radially symmetrical about the axis of the can for a balanced construction to simplify the manufacture of the end but even this is not essential.

Figure 4:
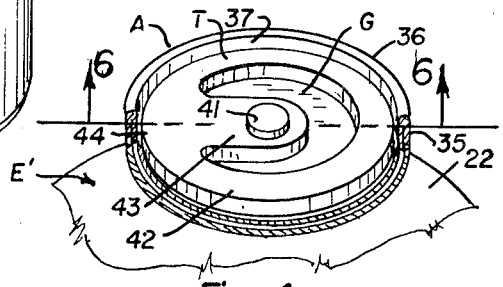
FIG. 4 is a fragmentary isometric view of the apex portion of the end shown at FIG. 2, but on an enlarged scale and partially in section to more clearly depict the structure thereof.
Figure 5:
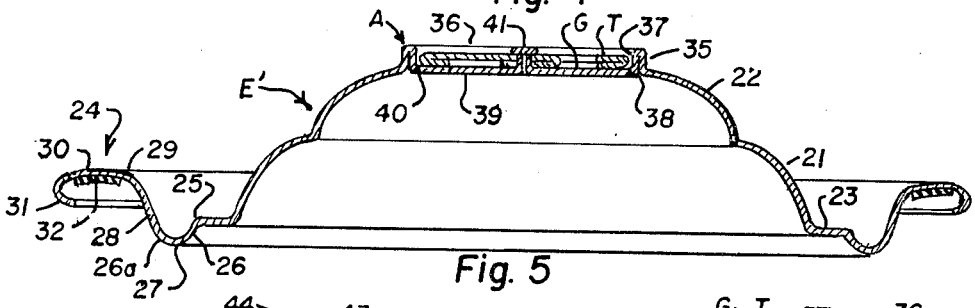
FIG. 5 is a sectional view of a can end, similar to the showing at FIG. 2 but on an enlarged scale and showing the end before it is seamed onto a can.
Figure 6:
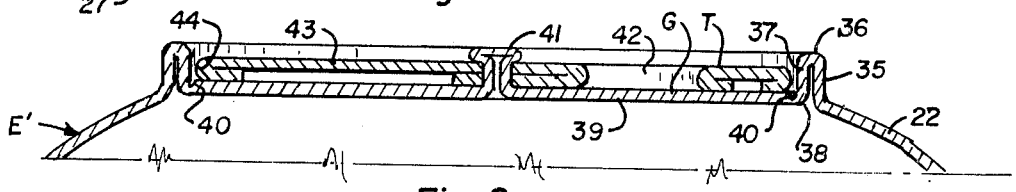
FIG. 6 is a sectional view as taken from the indicated line 6—6 at FIG. 4 but on an enlarged scale.

The improved end construction is illustrated in further detail at FIGS. 4, 5, and 6. FIG. 5 shows the end E' before it is seamed to the cylindrical wall of the can body. This end E' may include a flat circular panel 23 wherein the cone-like frustum, consisting of spherical segments 21 and 22, is drawn with the base of the segment 21 being at the panel 23, and at or near its outer boundary so that the panel 23, if it exists, forms only a comparatively narrow shoulder.

The panel 23 is surrounded by a skirt of peripheral seaming and strengthening radii 24. The panel boundary is at a short downturned expansion radius 25 which turns to a chuck panel radius 26 having its bottom forming the edge 27 of a chuck panel. An outward chuck panel radius **26*a* turns to an extended chuck wall 28. The upper crest of this chuck wall turns outwardly to a seaming panel radius 29 from whence a circular seaming panel 30 outstands with the outward edge being downturned to form a curl 31. A latex seaming compound 32 is provided at the inner portion of the seaming panel 30 to complete the peripheral radii 24 of the end. The formation of this panel 23, the wall of the conical frustum 21–22, of FIG. 2, or the cones 20 and 20' of FIGs. 1 and 3, and the peripheral radii 24** are conventional and need not be further described.

The aperture A at the apex of the cone is a short ring-shaped spout, including a short upstanding outer lip 35, turned upwardly from the cone-like surface 22, or 20 or 20'. The drawn metal forming the end turns at the crest 36 of this lip 35 as an 180-degree downward fold as the inner orifice wall 37 of the aperture A. The height of the lip 35 will not exceed the diameter of the curl 31 to permit stacking and nesting as with conventional end units. The height of lip 35 may be approximately 0.085-inch as a suitable maximum.

Thence, the drawn metal extends from an inward 90-degree fold 38 at the base of the orifice and across the aperture to form a recessed gate panel 39 wherein the gate G is formed. This gate G includes essentially the entire panel 39 and is defined by a circumferential score cut 40 adjacent to, or at the fold 39. A rivet 41 is drawn at the center of the panel 39, the gate G. The pull tab T is attached to this rivet. The pull tab is preferably formed of folded metal. The folds may be as in the manner best illustrated at FIG. 6. The pull tab T is formed by the orifice wall 37. An inwardly projecting tongue 43 at one side of this ring 42 extends to the center of the orifice to connect with the rivet 41 to complete the gate structure.

The gate is opened by lifting the ring 42 opposite the tongue 43. The tongue 43, attached to rivet 41, levers the outer edge 44 of the ring 42, adjacent to the tongue 43, to push downwardly to break the score cut 40. Then a continued pull of the ring enables the gate G to be lifted and torn away from the aperture.

Figure 7:
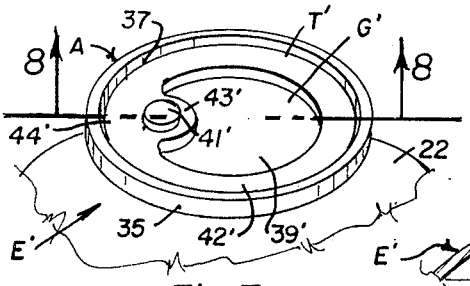
FIG. 7 is a fragmentary isometric view of the apex portion of an end, similar to FIG. 4, but illustrating a modified arrangement of the components depicted therein.
Figure 8:
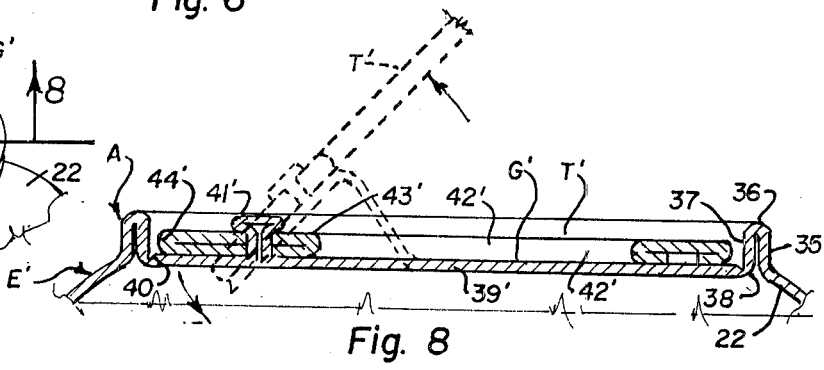
FIG. 8 is a sectional view as taken from the indicated line 8—8 at FIG. 7, but on an enlarged scale and with broken lines indicating a position of the gate and tab as it is being opened.

FIGS. 7 and 8 illustrate a variation of the structure above set forth. The aperture A is essentially the same, with a lip 35, crest 36, orifice wall 37, and an inward 90-degree fold 38 to form thepanel 39'. The gate G' in the panel 39', and the panel itself is modified by offsetting the rivit 41' to provide for a short tongue 43' on the ring 42'. With this arrangement the ring 42' can exert greater leverage against the score cut to open the gate by lifting the ring, as to the position shown in broken lines at FIG. 8, and then tearing the gate out of the orifice by pulling the tab as heretofore described.

Figure 9:
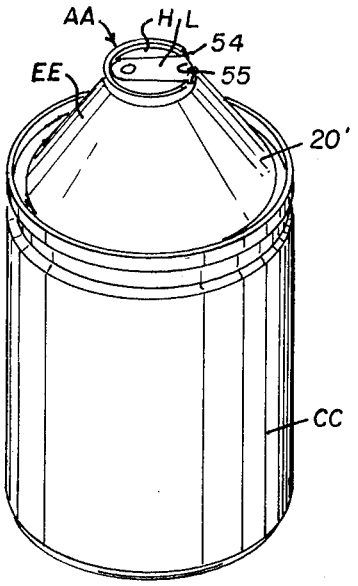
FIG. 9 is an isometric view of a can having a conical end similar to FIG. 1 but illustrating a modified embodiment of a push-in gate and a lift lever.

Some states require non-removable gates on beverage cans and various types of gates are provided which are pushed downwardly into the can with an edge of the gate being hinged to the end. FIGS. 9 and 14 illustrate an improved arrangment for providing a hinged gate H in the raised aperture A of a conical end. The end construction is essentially the same as that hereinbefore described. As shown at FIG. 9, a can CC is provided with a conical end EE with an aperture AA at its apex. A hinged gate H is formed at this aperture and a lever L is attached to the hinged gate to be lifted to open the gate. The lever l shown at FIGS. 10, 12, 13, and 14 is illustrated as being a bar-type lever, as will be further described, but the lever may also be a ring-type lever L' as shown at FIG. 11.

Figure 10:
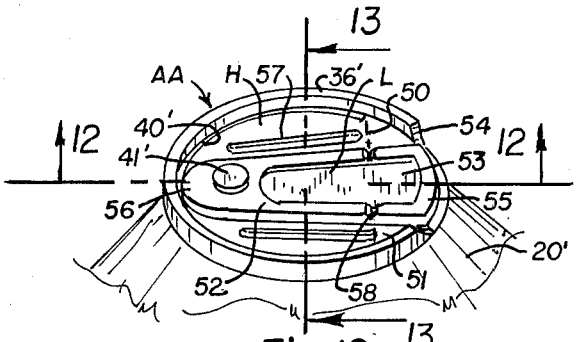
FIG. 10 is a fragmentary isometric view of the apex portion of the end shown at FIG. 9, but on an enlarged scale.
Figure 11:
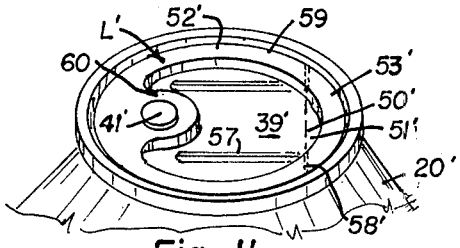
FIG. 11 is a fragmentary isometric view, similar to FIG. 10 but showing a modified type of lift lever.
Figure 12:
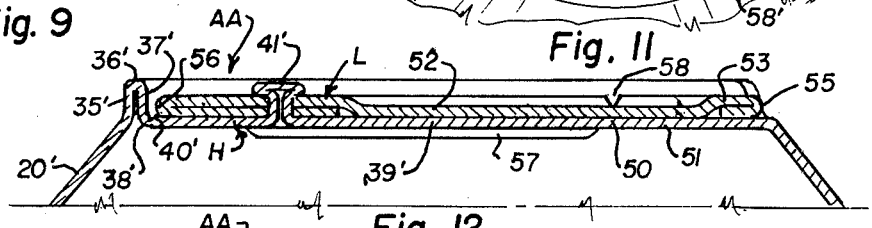
FIG. 12 is a sectional view as taken from the indicated line 12—12 at FIG. 10 but on an enlarged scale.
Figure 13:
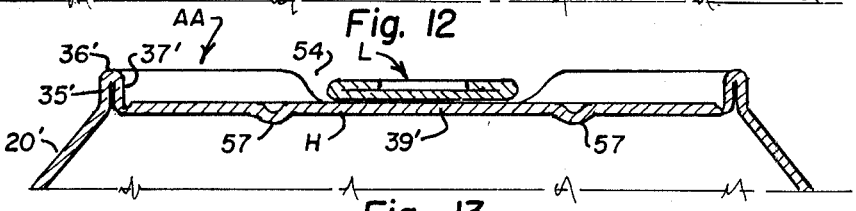
FIG. 13 is a sectional view as taken from the indicated line 13—13 at FIG. 10 but on an enlarged scale.
Figure 14:
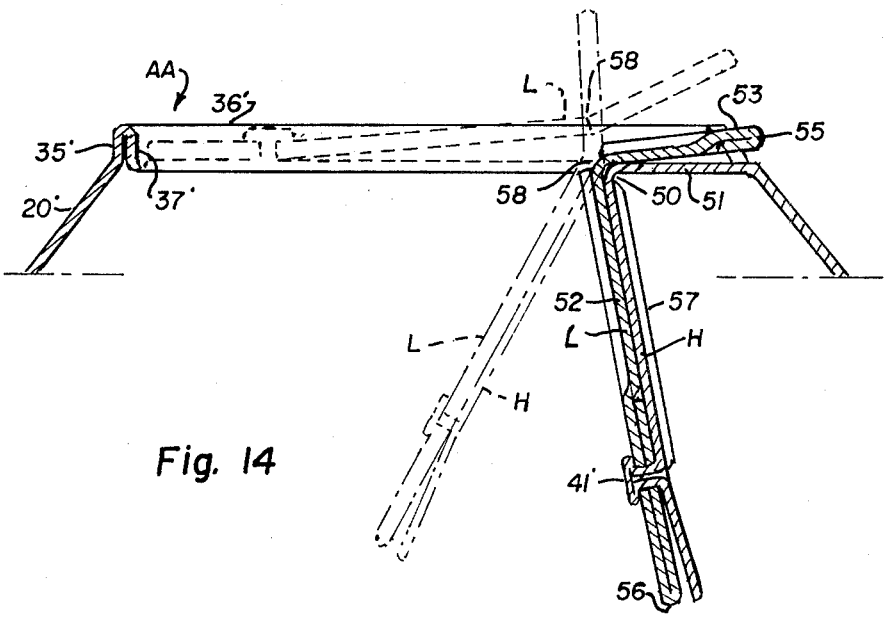
FIG. 14 is a sectional view similar to FIG. 12 but showing the gate as being pushed downwardly, as to open a can, with dotted lines indicating the position of the lift lever as it commences to open the gate and with dashed lines indicating an intermediate position, when the gate is partially open.

Referring now to FIGS. 10, 12, and 13, the apex of a concial end 20', forming the aperture AA is a short ring-shaped spout including a short, upstanding lip 35' turned upwardly from the cone-like surface 20'. A crest 36', an 180-degree fold, turns to an inner orifice wall 37' of the aperture AA. The height of the lip 35' is limited to permit nesting and stacking of the ends as heretofore described. The lower edge of the orifice wall 37' is at a 90-degree inward fold 38' to form a recessed gate panel 30'

A score cut 40' extends about the panel 39', adjacent to the orifice wall 37', through approximately three-fourths of the circumference of the panel to define the hinged gate H with the hinge edge 50 being a geometrical chord extending across the panel 39' at the ends of the orifice cut. The remaining panel portion 39', which remains over the aperture when the gate H is opened, defines a shoulder 51. This shoulder, though across the aperture AA, is not of sufficient area to impede the flow of a beverage from the can.

The lever L, which is attached to the gate H, is a folded piece of metal. The lever L will lie in the recess formed by the orifice wall 37' of the aperture AA across the aperture and normal to the hinge edge 50. The gate portion 52 of the lever, overlying the gate H is connected to the gate H by a rivet 41' in the gate. The lift portion 53 of the lever overlying the panel shoulder 51 may extend into a breach 54 in the walls 35' and 37' of the aperture. This permits the outer edge 55 of the lift portion 53 to be more easily gripped for lifting when the end is to be opened.

The connection of the lever L to the gate H by the rivet 41' is near the edge of the gate opposite to the hinge 50 and the end edge 56 of the gate portion 52 is at the score cut 40'. Thus, when the lever is lifted the rivet 41' will act as a fulcrum to cause the end edge 56 of the lever to break the score cut 40' and permit a downward movement of the gate with tearing of the score cut 40' and separation of the gate from the aperture. The gate will bend somewhat near the rivet 41' as this tearing action commences. However, an excessive bending of the gate H by the lever L at the rivet is prevented by corrugations 57 in the gate which stiffen the gate to insure bending at the hinge line 50 as continued movement of the lever pushes it downwardly.

The lift end 53 of the lever L will upstand from the aperture AA as a short tab when the gate is pushed downwardly to its open position, as indicated in dashed lines at FIG. 14. This may be objectionable and preferably the lift end 53 will be returned to its original position upon the shoulder 51 of the panel 39 by bending the lever L at the hinge 50. This must be done without returning the hinged gate H from its fully open positon.

This is accomplished by a differential weakening of the lever L at the hinge 50. A small, narrow notch 58 is cut into the top surface of the lever L between the gate portion 52 and the lift portion 53. When the lever is first lifted, by raising the lift portion 53, the lever bends at the notch 58 until the notch closes. The lever L is then positioned as shown in dotted lines at FIG. 14. This initial movement of the lift portion 53 of the lever enables it to be more easily gripped. Further lifting first exerts pressure at the rivet 41', now acting as a fulcrum until the end edge 56 breaks the score cut. This permits the gate to be opened, by rotating the lever L, the dashed lines at FIG. 14 showing the gate as being partially open. When the gate is fully opened, the lift portion 53 of the lever is returned to its initial position against the shoulder 51. The lever L, weakened to bend at the notch 58 permits the gate and the gate portion 52 of the lever to remain in the downward open position, as shown in full lines at FIG. 14.

FIG. 11 shows another mode of forming the lever, using a ring-shaped lever L'. This ring-shaped lever L' may be described as having a gate portion 52' overlying the gate H', and a lift portion 53' overlying the shoulder 51'. The body of the lever is a ring 59, formed as heretofore described, with a tongue 60 inside the ring, at the gate portion 52' to connect with a rivet 41' in the gate H. The rivet 41' may be either at one side of the aperture panel as shown or at the center as shown at FIGS. 1 to 6. Otherwise, the gate H is essentially the same as heretofore described except the score cut 40' is preferably extended further about the panel 39' to reduce the size of the hinge 50' and provide a narrow shoulder 51'. The ring 59 will lie completely within the aperture recess and thus the breach in the aperture wall may be eliminated.

The manner in which this gate opens is similar to that heretofore described. Lifting the ring 59 at the portion over the shoulder 51' causes the score cut 40' to rupture and then rotation of the ring causes the gate to swing downwardly as the score cut 40' tears from the aperture. The final opening movement will be a pushing of the ring 59 downwardly to cause a bending at the hinge edge 50'. With a comparatively small shoulder 51', the lift portion 53' of the ring will also be comparatively small and it will not project from the aperture a significant distance above the aperture. By extending the score cut 40' a sufficient distance about the panel 39' the projection of the lift portion 53' of the ring 59 will not be significant. However, notches 58' may be cut into this ring 59 at the hinge 50, as heretofore described if it is desirable to push the lift portion 53' of the ring against the surface of the shoulder 50.

I have now described my invention in considerable detail. However, it is obvious that others skilled in the art can build and devise alternate and equivalent constructions which are, nevertheless, within the spirit and scope of the invention. Hence, I desire that my protection be limited, not by the constructions herein described, but only by the proper scope of the appended claims.

What is claimed is:

1. A conical can end wherein the central panel of the end is drawn to form a cone-like frustum with the apex end thereof constituting an aperture, a gate panel recessed below the crest of the aperture closing the same, a score cut in the gate panel to outline a gate and a tab lying in the aperture recess, attached to the gate and being adapted to rupture the score cut by a lever action whenever an edge of the tab is lifted from the aperture recess, whereby to permit the gate to be opened.

2. The conical can end defined in claim 1 wherein the score cut extends completely about the gate outline and the gate is removed from the panel to open the same by pulling the tab away from the recess after the score cut is ruptured.

3. The conical can end defined in claim 2 wherein: the aperture is circular and the recess is defined by an inner orifice wall, inwardly from the apex crest and the score cut is adjacent to the inner orifice wall; and wherein the tab is formed as a ring fitted into the recess and having a tongue that projects inwardly from one side of this ring and a rivet means attaches the tongue to the gate panel.

4. The conical can end defined in claim 3 wherein the rivet means is at the center of the panel and at the can axis.

5. The conical can end defined in claim 3 wherein the score cut extends partially about the gate outline to provide a hinge portion across the gate panel between the end points of the score cut, and the gate is pushed into the end to open the same and wherein the tab is a lever adapted to be lifted from the recess to rupture the score cut and rotated to push the gate into the end to an open position.

6. The conical can end defined in claim 5 wherein the aperture is circular and the recess is defined by an inner orifice wall inwardly from the apex crest, and the score cut is closely adjacent to the orifice wall; and wherein the lever is a bar-like member extended across the aperture normal to the hinge, and a rivet means attaches the lever to the gate panel.

7. The conical can end defined in claim 6 wherein the recess is interrupted by a breach adjacent to the hinge, and the end of the lever bar is at this breach and exposed at the outer side of the aperture to facilitate gripping the same.

8. The conical can end defined in claim 6 wherein a directional weakening means is formed in the lever adjacent to the hinge to provide a full strength action when the lever is lifted and rotated to open the gate but weakened when rotated in the opposite direction whereby to permit the lifting end of the lever to be bent adjacent to the hinge from a position projected above the aperture to an out-of-the-way position in the recess after the gate is opened.

9. The conical can end defined in claim 8 wherein the weakening means comprises a notch in the lever.

10. The conical can end defined in claim 5 wherein the aperture is circular and the recess is defined by an inner orifice wall inwardly from the apex crest and the score cut is adjacent to the orifice wall; and wherein the lever is a ring fitted into the recess and a tongue portion projects inwardly from one side of this ring and a rivet means attaches the tongue to the gate panel.

11. A conical can end adapted to be nested and stacked for storage comprising:

a central panel drawn to form a cone-like frustum;

a skirt of peripheral seaming and strengthening radii surrounding the central panel with the outer edge forming a curl, with the curl diameter establishing the spacing for stacking one can end on another; and a ring-shaped aperture at the apex of the frustum having a recessed gate panel and wherein the aperture ring above the apex has a height which is less than the curl diameter to permit stacking of ends at the spacing established by the curl.

* * * * *